United States Patent [19]

Greenberger

[11] Patent Number: 4,617,815

[45] Date of Patent: Oct. 21, 1986

[54] APPARATUS FOR DESCALING HOT STRIP IN A ROLLING MILL

[75] Inventor: Joseph I. Greenberger, Pittsburgh, Pa.

[73] Assignee: Wean United, Inc., Pittsburgh, Pa.

[21] Appl. No.: 685,817

[22] Filed: Dec. 24, 1984

[51] Int. Cl.[4] ..... B21B 45/08; B21B 45/02

[52] U.S. Cl. ..... 72/39; 72/201

[58] Field of Search ..... 29/81 B, 81 K; 72/39, 72/40, 201; 239/589, 590.3, 590.5, 592, 597; 266/113

[56] References Cited

U.S. PATENT DOCUMENTS

| | | | |
|---|---|---|---|
| 3,779,054 | 12/1973 | Greenberger | 72/201 X |
| 3,878,991 | 4/1975 | Sabadics et al. | 239/592 X |
| 4,043,166 | 8/1977 | Leroy | 72/39 |
| 4,076,222 | 2/1978 | Schaming | 266/111 |
| 4,210,288 | 7/1980 | Dobson | 239/597 |
| 4,300,376 | 11/1981 | Wilmotte | 72/201 |

FOREIGN PATENT DOCUMENTS

| | | | |
|---|---|---|---|
| 103731 | 6/1982 | Japan | 72/39 |
| 359077 | 11/1972 | U.S.S.R. | 72/39 |
| 990360 | 1/1983 | U.S.S.R. | 72/39 |

*Primary Examiner*—E. Michael Combs

*Attorney, Agent, or Firm*—Suzanne Kikel

[57] ABSTRACT

A thin coherent, high pressure volume, curtain water wall of liquid is applied in a transverse direction across a surface of a strip in a hot rolling mill to uniformly remove oxide scaling from the strip's surface. A header is designed to have several passages which produce several discrete liquid flows which are directed into a pressure equalization zone prior to their entering the nozzle section of the header to create upon the flow's exiting from the nozzle section a curtain wall of fluid having a thickness which delivers a uniform sufficient impact force against the strip's surface for the descaling process thereof.

9 Claims, 8 Drawing Figures

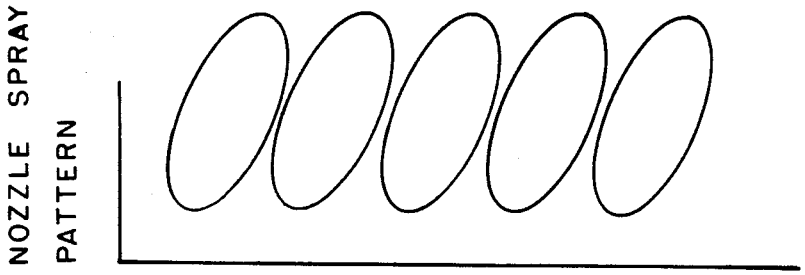
FIG. 4 – PRIOR ART
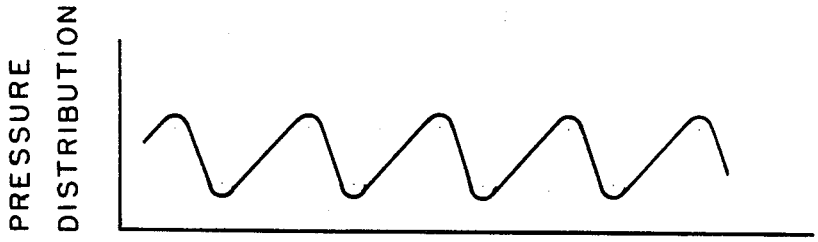
FIG. 5 – PRIOR ART
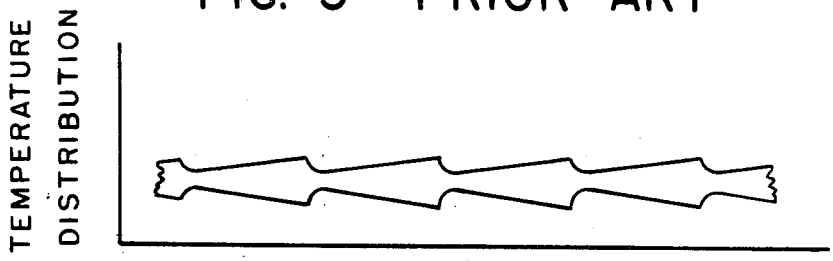
FIG. 6 – PRIOR ART
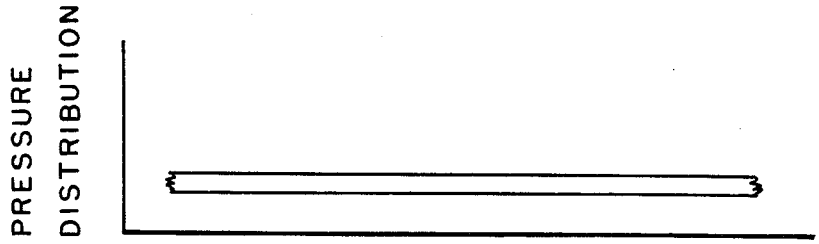
FIG. 7
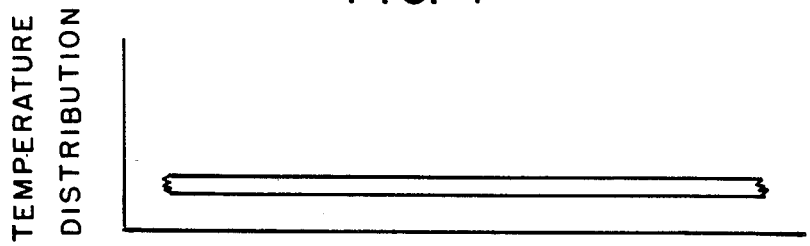
FIG. 8

APPARATUS FOR DESCALING HOT STRIP IN A ROLLING MILL

BACKGROUND OF THE INVENTION

The present invention relates to an economical process and apparatus for effectively and uniformly removing oxides from the surface of a hot workpiece by applying a uniform liquid force against the surfaces of the workpiece as it travels through a rolling mill train. More particularly, it relates to descaling hot steel slabs, plate or strip in hot mill rolling operations, especially where descaling stations are located in the roughing and finishing stages of the rolling operations.

Conventional practices for descaling or removing oxides from a workpiece in a hot strip rolling mill where the workpiece is passed through the several stands of the mill carrying work rolls for receiving the workpiece for its reduction generally involves the use of nozzles. Typically, several nozzle header arrangements are positioned adjacent to and between the stands for spraying water under high pressures of 2000 to 3000 psi across the top and bottom surfaces of the workpiece basically to remove the scale formations as taught in U.S. Pat. No. 3,518,736.

These nozzles of these header arrangements are designed such that they produce an elongated elliptical impact zone and are usually angled and canted between 10° to 15° resulting in an overlapping spray effect when the sprays impinge against the surface of the strip as shown in the drawings herein. The sprays of these angled and canted nozzles when tested on surfaces such as pressboard or soft lead create obvious impact impressions which vary from shallow to deep. Such impact patterns mean that similar patterns are produced on a surface of a hot steel workpiece for scale removal in that the surface temperature varies along the elliptical impact zones of the spray nozzles.

In addition to these impact pressure variations, there exists water volume variations at different locations within the elliptical impact zones which also create this cyclic temperature pattern across the width of the workpiece. This cyclic temperature pattern of the present descaling nozzles can actually be seen as a longitudinal streaking pattern on the surface of the workpiece, particularly upon its travel from the roughing mill to the finishing train. Such streaking patterns indicate erratic scale removal by the present descaling systems and it is apparent that these streaking patterns are detrimental to both the quality of the workpiece and the rolling operations.

Regardless of the location of the nozzles relative to the workpiece, it is inherent due to the nozzle design, that cyclic pressure impact patterns are always produced resulting in cyclic scale removal as well as cyclic surface temperature patterns across the width of the workpiece. This cyclic temperature pattern results in cyclic secondary scale formation and cyclic rolling characteristics in the workpiece upon subsequent rolling operations.

As mentioned above, this uneven or cyclic removal of scale is unsatisfactory in that the end result is poor surface quality and non-uniform metallurgical characteristics in the finished product. Also, as the workpiece travels from one stand to the next, the newly formed secondary oxides on the workpiece are continually forced against the surface of the work rolls eventually causing non-uniform wear patterns thereon, which rolls then have to be reground or changed much more frequently compared to the condition where there is uniform water volume, uniform pressure and uniform temperature distribution across the surface of the workpiece.

The pressure of the liquid delivered to the present nozzle descaling arrangements fall in an extremely high range demanding very costly and complicated descaling equipment.

SUMMARY OF THE PRESENT INVENTION

It is therefore an object of the present invention to provide a method and apparatus for optimizing the quality of a hot workpiece by uniformly removing the scale oxide formations from the surfaces thereof.

More particularly, it is an object of the present invention to apply a full width thin uniform rectangular field of water against the workpiece to uniformly remove the scale oxides, thus applying a uniform impact pressure and water volume to eliminate the temperature variations across the strip.

A further object of the present invention is to provide a method and apparatus for continuously delivering this uniform water field against the strip regardless of the distance between the nozzle and the surface of the workpiece through inexpensive and simple equipment and low operational costs.

In particular, it is an object of the present invention to supply relatively lower pressurized liquid compared to the high pressure needed for the prior nozzle arrangements to an apparatus designed to create and deliver a uniform high pressure volume of water in the form of a thin, continuous, coherent curtain wall such that upon its impingement against the surface of the workpiece, this wall of liquid acts as a knife to uniformly remove the oxides.

A still further object of the present invention is to provide an apparatus for applying a continuous wall of relatively high pressure volume of liquid to a surface of an elongated workpiece of hot metal passing above or below and adjacent to said apparatus to substantially and uniformly remove oxide scales from said surface where there is relative movement between said workpiece and said apparatus, comprising header means spaced from said surface and arranged transversely along two opposite sides of said workpiece, said header means comprising nozzle means assembled in said header means having an elongated exit opening extending parallel to said header for directing said high pressure volume continuous wall of liquid onto said surface of said workpiece, channel means extending through said header means in said transverse direction for receiving pressurized liquid, and liquid diffusion and pressure equalizing means in said header means communicating with said channel means, comprising a series of passages formed in a common portion of said channel means, chamber means constructed and arranged to have an enlarged area relative to said passages for receiving said flow of liquid from said passages, liquid directing means arranged in said chamber means for directing said flow of liquid in a direction substantially different to the direction of said flow from said channel means into said chamber means, and a restriction area adjacent said liquid directing means and said enlarged area for directing said liquid from said enlarged area into said nozzle means, said nozzle means having means in conjunction with said treatment of the liquid in said chamber means for causing said liquid passing therethrough to form a rectangular, continuous field of pressurized liquid sufficient to create a uniform high impact force within the rectangular field for said substantial and uniform removal of said oxide scale from said surface of said workpiece.

And a still further object of the present invention is to provide a method of improving the operation of a hot strip mill and quality of the hot strip product thereby by the optimization of the removal of scale oxide during the rolling of the strip, the steps comprising immediately prior to the strip entering one of the stands of the hot strip mill applying liquid under relatively high pressure volume to the top and bottom surfaces of the strip, and controlling the application of the liquid so that the point of impact with said surfaces of the strip will be in the form of a thin uniform rectangular continuous field of liquid pressure sufficient to create a uniform high impact force, thereby to substantially and uniformly remove said oxide scale from said surfaces.

BRIEF DESCRIPTION OF THE DRAWINGS

These objects, as well as other novel features and advantages, of the present invention will be better appreciated and understood when the following description thereof is read along with accompanying drawings of which:

FIG. 4 is a schematic illustrating several elongated ellipitical impact zones and a slight overlapping effect at the impacting spray pattern of the nozzle arrangements of the prior art;

FIGS. 5 and 6 illustrate pressure and temperature distribution curves respectively across the width of a strip obtained by prior art descaling practices; and FIGS. 7 and 8 illustrate pressure and temperature distribution curves, respectively as obtained by following the teachings of the subject invention.

DESCRIPTION OF A PREFERRED EMBODIMENT

Figure 1:
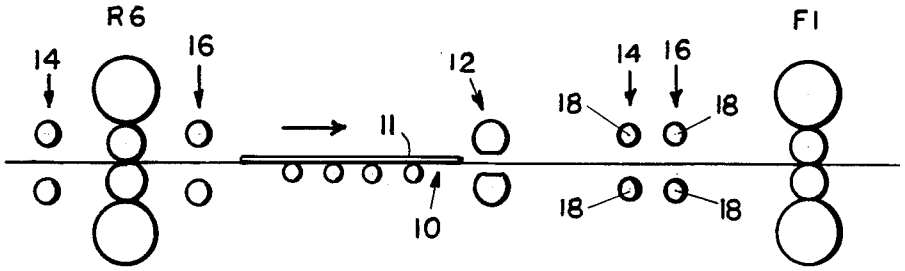
FIG. 1 is a diagrammatic view of the last roughing mill stand of a hot roughing mill train, the delay table, and descaling units between a shear and the first stand of a hot finishing train, the descaling units being in accordance with the teachings of the subject invention.

In referring first to FIG. 1, the strip mill components follow well-known construction and operation of a hot strip mill except for the operation and design of the descaling means which involves the present invention. To the extreme left of FIG. 1 is the last stand of a six stand hot roughing mill train identified as R6, and to the extreme right there is a first stand F1 of the hot finishing mill train. Between R6 and F1 is a delay table 10 which receives transfer bar 11 prior to its entering F1, a flying shear 12, and two descaling units 14 and 16 arranged in parallel, spaced-apart fashion relative to the direction of the travel of transfer bar 11, which is traveling left to right in FIG. 1, and the final product of which is a hot steel strip.

Each descaling unit 14 and 16 consists of upper and lower headers 18 located relative to transfer bar 11 which is traveling from the roughing train to the hot strip finishing train, which descaling units 14, 16 are shown in FIG. 1 to be positioned after shear 12 and immediately in front of stand F1 of the finishing train, and before and after R6. Similar descaling units 14, 16 may also be located between the first stand to the fourth stand of the finishing train as shown in U.S. Pat. No. 3,779,054, as well as in several other locations in the roughing train. These descaling units 14, 16 of the present invention replace conventional high pressure spray nozzle descaling arrangements such as those disclosed in U.S. Pat. Nos. 3,518,736 and 4,251,956.

These descaling units 14, 16 constructed according to the teachings of the present invention are utilized to efficiently descale transfer bar 11 by applying a thin, uniform thickness of high pressure, volume water wall curtain of coolant, usually water, to both the top and bottom surfaces of transfer bar 11.

Figure 2:
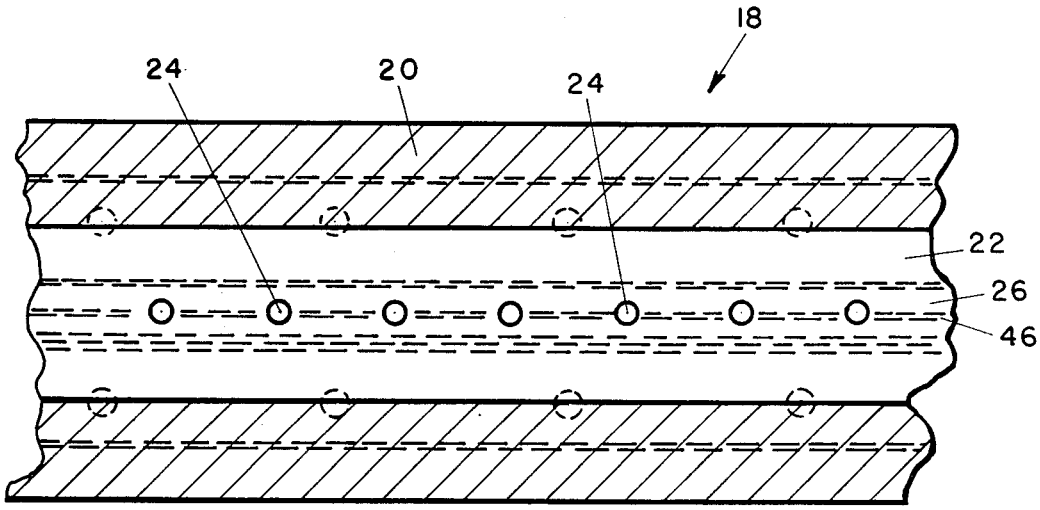
FIG. 2 is a longitudinal, cross-sectional view partly broken away of a top header for a descaling unit following the teachings of the subject invention and taken along lines 2—2 of FIG. 3.

For the purpose of this description let it be assumed that water under a controlled pressure and desired volume is introduced at the right hand end of header 18 as indicated by the arrow appearing in FIG. 2.

Figure 3:
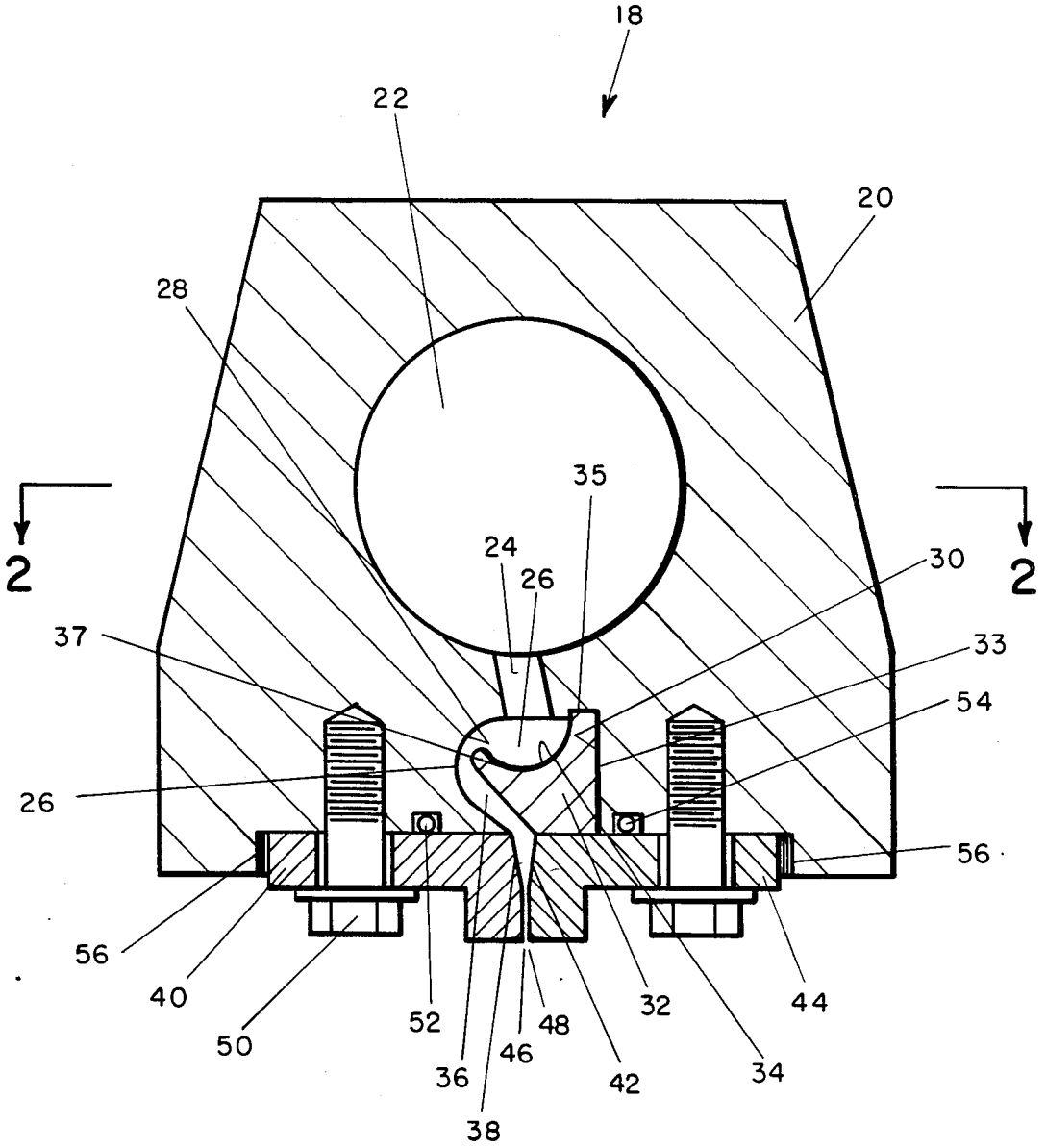
FIG. 3 is a cross-sectional view of the header of FIG. 2.

FIGS. 2 and 3 illustrate one of the similar headers 18; in this case the top header 18 for either descaling unit 14 or 16 shown in FIG. 1. Top header 18 consists of an elongated member 20 having a first chamber 22 extending substantially the full length of member 20. Extending radially from and communicating with first chamber 22 is a series of spaced-apart bored holes or passages 24, which are arranged on one tangent side of first chamber 22, and which series of passages 24 run along the length of member 20. These passages 24 in turn, communicate with a second chamber 26, which runs parallel to and extends the full length of member 20. Second chamber 26 is bored in member 20 and is formed to have a semi-circular portion 28 as shown to the left in FIG. 3 and a straight sided portion 30 as shown toward the right in FIG. 3.

Particularly referring to FIG. 3, mounted in second chamber 26 is a filler member 32 having a machined straight sided portion 33 that fits against the portion 30 of member 20. Filler element 32 has a top projection which fits into a cut-out section 35 located adjacent straight sided portion 30 of member 20. Lateral movement of filler member 32 is prevented due to its top projection keyed into cut-out section 35 of member 20.

The remaining configuration of filler member 32 is such that there is an enlarged area 34 having a curved guiding surface for the water flow, and forming a restricted area 36 with the second chamber 26. To the right of FIG. 3, it can be seen that a filler element 32 has a finger 37 which is part of enlarged area 34 and restricted area 36 which serves to direct the fluid from area 34 to area 36.

Still referring to FIG. 3, semi-circular portion 28 runs downwardly to meet an outer surface 38 of L-shaped member 40 which cooperates with an outer surface 42 of L-shaped member 44 to form nozzle section 46. These L-shaped members 40 and 44 are elongated pieces and extend substantially the same length as member 20. The positioning of these L-shaped members 40, 44 is such that a portion of their outer surfaces 38, 42 respectively converge with respect to each other to form a spaced-apart area for a liquid outlet sectic n in nozzle section 46 in such a manner that a relatively narrow elongated slot 48 is formed on the undersurface of header 18 which is best seen in FIG. 3.

In addition to the top projection and the straight-sided portion 33 of filler element 32 abutting against the corresponding surfaces of member 20, filler element 32 is further locked in chamber 26 through the abutment of L-shaped member 44 against filler element 32 and member 20 of header 18.

Header 18 is positioned such that elongated member 20 extends transversely across the width of transfer bar 11 where elongated slot 48 runs parallel to the width of transfer bar 11 for delivering a curtain wall of liquid transversely across and against the upper surface of bar 11. As shown particularly in FIG. 1, a similar header 18 is arranged below bar 11 where its elongated slot is projected upwardly in an opposite direction to that of elongated slot 48 of upper header 18 to deliver a curtain wall of liquid transversely across and against the bottom surface of bar 11.

The pressure and volume flow rate of the liquid for each the top and bottom headers 18 is controlled by the operator to attain the required even descaling of bar 11.

L-shaped members 40, 44 are two pieces separate from member 20 and are machined to fit and be mounted in member 20 through bolts 50 each located on opposite sides of elongated slot 48. An elongated gasket 52, 54 to the left and right respectively of chamber 26 in FIG. 3 also extends parallel to and in member 20. When viewing FIG. 3, the width of slot 48 is adjustable through movement of L-shaped members 40, 44 to the left or right of FIG. 3, which movement is achieved due to the clearance between member 20 and L-shaped members 40, 44 and the annular clearance existing between L-shaped members 40, 44 and bolts 50.

Once L-shaped members 40, 44 are positioned to give the desired spacing between outer surfaces 38, 42 of L-shaped members 40, 44, shims 56 are positioned to take up the existing clearance between L-shaped members 40, 44 and member 20. As is apparent, the thickness of shims 56 will vary according to the desired width of elongated slot 48, and thus the desired width or thickness of the waterwall flow delivered by nozzle section 46.

Typically, for a volume flow rate of 5 to 10 gallons per minute per inch of width and a pressure range of 1,000 to 2,500 psi, the distance outer wall 38 is spaced from outer wall 42 of members 40, 44 would fall in the range of 0.006 to 0.010 inch. This uniform thin width of curtain wall results in a more concentrated impact force and therefore a highly effective and optimized descaling action.

When shims 56 are fitted between L-shaped members 40, 44 and member 20, movement of the L-shaped members is further held in place by tightening bolts 50.

In referring again to FIG. 3, the upper portion of outer walls 38 and 42 of nozzle section 46 forms an acute angle with respect to an axial vertical plane and the lower portions run parallel to this same vertical plane. It is also shown that passages 24 positioned below first chamber 22 are slanted at an acute angle relative to this axial vertical plane in FIG. 3 toward enlarged area 34. For increased life, outer walls 38 and 42 of nozzle section 46 can have a special surface such as a ceramic coated surface, or a carbide, or a heat treated alloy steel surface.

Enlarged area 34 and restricted area 36 formed by filler member 32 in second chamber 26 are some of the important features of the present invention. As an example of how these components 34 and 36 come into play, for removing scale from the top and bottom surfaces of, for example, an 80 inch wide and 1.25 to 1.50 inch thick transfer bar travelling at 100 to 200 feet per minute at a temperature of 1800° F. to 1900° F. into the first stand of the finishing train, pressurized fluid at approximately between 1,000 to 2,500 psi and a flow rate of 5 to 10 gallons per minute per inch of width is delivered through a conduit (not shown) into one or both ends of first chamber 22. The flow is fed into passages 24 from where it then enters diffusion zones consisting of the aforesaid enlarged and restricted areas 34 and 36. Due to the direction in which passages 24 run, each liquid flow from passages 24 travels towards the back portion of the circular configuaration of enlarged area 34 which is to the right in FIG. 3 where a pressure equalization occurs prior to its travel around finger 37 of filler element 32 into restricted area 36 formed by member 20 and finger 37, where additional pressure equalization occurs.

It will be noted that the desired control and treatment of the liquid is achieved by the angle of passages 24 relative to the formation of the curve surface and the form and disposition of finger 37 of member 32. Also involved is the particular angle of deflection of the liquid caused by the curved surfaces 28 and 34 which is not interferred with by finger 37 and the other end of finger 37 forms the narrowest dimension of restricted area 36, and thus optimizing diffusion and the flow pattern into nozzle section 46.

Through this restricted area 36, the flow velocity is increased, and therefore, the flow velocity is greater than that when in enlarged area 34. The liquid flow at this higher speed travels down into nozzle section 46 where it is then delivered through elongated slot 48 as a continuous, coherent water wall curtain onto the top surface of transfer bar 11.

As mentioned previously, a header similar to header 18 is located below transfer bar 11 as is shown in FIG. 1, and operates in the same manner in that it delivers a thin high pressure volume curtain water wall of liquid upwardly against the bottom surface of transfer bar 11. Both headers 18 of each descaling unit 14, 16 are operated according to present operating procedures for descaling. Each flow is delivered transversely across the width of transfer bar 11 and its concentrated impact force and descaling action against the bar 11 is powerful and uniform to give a knife effect action to uniformly remove scale from the lower and upper surfaces thereof. The temperature of the surface of the bar 11 is quickly reduced to a degree so that the oxide scale thereon becomes very brittle for its uniform removal.

FIG. 4 indicates the water pattern which the sprays of the high pressure nozzles of the prior art make upon the surface of the bar 11 when looking down onto it, which are in the form of several elongated elliptical zones. As indicated to be the condition or disadvantage of these nozzles of the prior art, the spray effects overlap with that of an adjacent nozzle to give the cyclic pressure, temperature and descaling results, which impact pressure and temperature distribution curves are shown in FIGS. 5 and 6.

As is seen in FIG. 5, the impact pressure of the nozzle streams resembles a sinusoidal curve signifying an uneven pressure across the width of the strip, thus representing the descaling action as also being cyclic. The same is true for the temperature distribution curve in FIG. 6 which shows that the temperature effects across the strip are also cyclic. Contrary to this, as FIGS. 7 and 8 show, the impact pressure and temperature distribution curves of the descaling arrangement of the present invention resemble substantially straight lines indicating uniform descaling and cooling effects across the width of transfer bar 11.

The present invention has been described in the environment of a hot rolling mill for rolling strip; however, with little or no alterations, the present invention may be adapted to other descaling operations, such as hot or cold bar, tube, and plate, and to altogether other individual applications where a uniform high energy application of fluid is required. Also, the cooling liquid in most cases is water, however, it may be one of many cooling fluids, such as solutions of oil and water, or freon, or air.

In accordance with the patent statutes, I have explained the principle and operation of my invention and have illustrated and described what I consider to be the best embodiment thereof.

I claim:

1. In an apparatus for applying a continuous wall of relatively high pressure volume of liquid to a surface of an elongated workpiece of hot metal passing above or below and adjacent to said apparatus to substantially and uniformly remove oxide scales from said surface where there is relative movement between said workpiece and said apparatus, comprising:

header means spaced from said surface and arranged to extend transversely across said workpiece, said header means comprising:

nozzle means carried by said header means having an elongated exit opening extending parallel to said header for directing said high pressure volume continuous wall of liquid onto said surface of said workpiece, channel means extending through said header means in said transverse direction for receiving pressurized liquid, and liquid diffusion and pressure equalizing means in said header means communicating with said channel means, comprising a series of parallel liquid passages each with a discharge opening formed in a common portion of said channel means and having a pressure equalizing effect on said liquid, chamber means constructed and arranged to have an enlarged area relative to each adjacent said discharge opening formed by said passages for receiving said flow of liquid from said passages, said enlarged area having a back portion, said passages being directed toward said back portion of said enlarged area to direct said flow in a first direction in said chamber means thereby effecting a further pressure equalization of said flow, liquid directing means received in said enlarged area of said chamber means for directing said flow of liquid in a subsequent second direction substantially different from said first direction to further effect a pressure equalization of said flow, and said liquid directing means forming a restriction area with said enlarged area for influencing the flow of liquid after passing in said second direction and for directing said liquid from said enlarged area into said nozzle means, said channel means, said chamber means, and said elongated exit opening of said nozzle means being in substantial alignment relative to each other, said nozzle means in conjunction with said treatment of the liquid in said chamber means causing said liquid passing through said nozzle means to form a rectangular, continuous field of pressurized liquid sufficient to create a high energy impact force within the rectangular field for said substantial and uniform removal of oxide scale from said surface of said workpiece.

2. In an apparatus according to claim 1, said high pressure volume of liquid being in the range from 5 to 10 gallons per minute per inch and from 1,000 to 2,500 pounds per square inch, and wherein said liquid passing means of said nozzle means includes opposed surfaces which are spaced-apart to form a desireable thickness for said wall of liquid, said thickness for said wall of liquid being in the range of 0.006 to 0.010 inch.

3. In an apparatus according to claim 1, wherein said workpiece is a strip being rolled in a hot rolling mill and which moves relative to said apparatus, and wherein said series of passages are radially and parallelly arranged and receive the liquid from said channel means for producing and delivering several discrete flows into said chamber means.

4. In an apparatus according to claim 2, wherein said discharge openings of said passages are substantially equally spaced apart circular openings, and wherein each passage is formed such that said discrete flows of liquid are directed in a direction away from said restriction area and towards said back of said enlarged area of said chamber means where the pressure of said flow is given said equalization affect.

5. In an apparatus according to claim 1, wherein said workpiece moves relative to said header means and said header means includes a said header means mounted above and a said header means mounted below said workpiece in a manner that a said rectangular continuous field of liquid is caused to impinge upon the top and bottom surfaces of said workpiece for said uniform removal of oxide scale therefrom.

6. In an apparatus according to claim 1, wherein said liquid passing means of said nozzle means includes opposed surfaces which are spaced-apart to form a desireable thickness for said wall of liquid, and wherein said nozzle means further comprises:

means for varying said uniform rectangular, continuous field of liquid pressure constructed and arranged in a manner that said opposed surfaces of said nozzle means are adjustable relative to each other for varying said thickness of said liquid wall.

7. In an apparatus according to claim 6, wherein said liquid passing means of said nozzle means consists of at least two spaced apart members forming said opposed surfaces for said forming of said uniform rectangular field of liquid pressure, and wherein said spaced apart members include adjustable means for varying the thickness of said liquid wall.

8. In an apparatus according to claim 7, wherein at least one of said spaced apart members is constructed and arranged to be slideably mounted in said header means.

9. In an apparatus according to claim 1, wherein said header means further comprises a filler member mounted in said chamber means having a surface configuration cooperating with the surfaces of said chamber means to form said enlarged area, said liquid directing means, and said restriction area existing in said chamber means.

* * * * *